US010240843B2

(12) United States Patent
Thayyullathil et al.

(10) Patent No.: US 10,240,843 B2
(45) Date of Patent: Mar. 26, 2019

(54) REFRIGERATOR ICE BIN

(71) Applicant: Viking Range, LLC, Greenwood, MS (US)

(72) Inventors: Jemsheer Thayyullathil, Greenwood, MS (US); Edward Thomas Lucic, Greenwood, MS (US); Kevin Brown, Greenwood, MS (US)

(73) Assignee: Viking Range, LLC, Greenwood, MS (US)

( * ) Notice: Subject to any disclaimer, the term of this patent is extended or adjusted under 35 U.S.C. 154(b) by 24 days.

(21) Appl. No.: 15/405,671

(22) Filed: Jan. 13, 2017

(65) Prior Publication Data

US 2017/0205130 A1 Jul. 20, 2017

Related U.S. Application Data

(60) Provisional application No. 62/278,792, filed on Jan. 14, 2016.

(51) Int. Cl.

| | |
|---|---|
| ***F25C 5/182*** | (2018.01) |
| ***E05D 5/06*** | (2006.01) |
| ***E05D 7/04*** | (2006.01) |
| ***F25D 11/00*** | (2006.01) |
| ***F25D 23/02*** | (2006.01) |

(52) U.S. Cl.

CPC ..... *F25C 5/182* (2013.01); *E05D 5/06* (2013.01); *E05D 7/0415* (2013.01); *F25D 11/00* (2013.01); *F25D 23/028* (2013.01); *E05D 2007/0469* (2013.01); *E05Y 2900/31* (2013.01); *F25D 2323/024* (2013.01)

(58) Field of Classification Search

CPC ..... F25C 5/182; B65D 25/2897; B65D 25/28; B65D 25/2867; B65D 25/325; B65D 25/2835; B65D 25/2852; A45C 13/22; A45C 2013/226

USPC ..... 220/761, 760, 767, 770, 773

See application file for complete search history.

(56) References Cited

U.S. PATENT DOCUMENTS

| | | | | |
|---|---|---|---|---|
| 4,573,577 A * | 3/1986 | Miller | B65D 21/062 | 206/506 |
| 4,801,034 A * | 1/1989 | Sandomeno | B65F 1/006 | 220/23.83 |
| 5,609,254 A * | 3/1997 | Loftus | B65D 21/041 | 206/506 |
| 5,715,968 A * | 2/1998 | Fink | A45C 3/04 | 220/669 |

* cited by examiner

*Primary Examiner* — Andrew T Kirsch
*Assistant Examiner* — Don M Anderson
(74) *Attorney, Agent, or Firm* — Baker Donelson; Dorian B. Kennedy

(57) ABSTRACT

An ice bin (10) is disclosed which includes a storage bin (13) having a pair of side walls (14), and an pair of end walls (15) and a bottom wall (16). The side walls have a T-shaped recess (17) having a central base recess (18) and two arm recesses (19). Each central base recess is defined by a floor ledge (21) and a pair of side edges (22). The end walls also have grip recesses (20) which extend directly from the arm recesses. The arm recesses are defined by side top ledges (28) while the grip recesses are defined by end top ledges (29). The ice bin also includes a pair of pivotable handles (23) coupled to the storage bin. Each handle has a pair of leg portions (24), a pair of arm portions (25), and a grip portion (26) extending between the pair of arm portions.

2 Claims, 2 Drawing Sheets

REFRIGERATOR ICE BIN

REFERENCE TO RELATED APPLICATION

Applicant claims the benefit of U.S. Provisional Patent Application Ser. No. 62/278,792 filed Jan. 14, 2016.

TECHNICAL FIELD

This invention relates generally to refrigerator components, and more particularly to the ice bin of a refrigerator.

BACKGROUND OF INVENTION

Refrigerators have existed for decades. Today's refrigerators oftentimes include an ice maker which provides ice cubes. Many refrigerators have an opening in the front door with a mechanism for dispensing the ice cubes through the front door opening upon the actuation of a lever with a receptacle such as a drinking glass. These types of refrigerators efficiently provide small amounts of ice. However, these types of refrigerators are not efficient in providing large quantities of ice.

Refrigerators have also been designed to include a removable ice bin, bucket or container which is housed within the freezer portion of the refrigerator. It should be noted that the just described refrigerator having an dispenser in the door may also include such a removable bin. The removable bin allows a person to transfer a larger amount of ice from the bin to another receptacle, such as an ice chest. A problem with these bins has been that they are difficult to lift and transport when filled with ice.

Accordingly, it is seen that a need remains for a ice bin that can be removed and transported in an easy manner. It is to the provision of such therefore that the present invention is primarily directed.

SUMMARY OF THE INVENTION

A refrigerator ice bin comprises a storage bin having a bottom wall, a pair of oppositely disposed side walls extending from the bottom wall, and a pair of oppositely disposed end walls extending from the bottom wall, each side wall has a recess therein defined by a floor ledge and two oppositely disposed side ledges extending upwardly from the floor ledge, and a pair of generally handles pivotally coupled to the storage bin side walls. Each handle has a pair of leg portions, a pair of arm portions extending from the leg portions, and a grip portion bridging the arm portions opposite the leg portions. The leg portions are coupled to the storage bin for pivotal movement of the handles between a stowed position and an in-use position. With the handles in the stowed positions, the leg portions are positioned generally vertically along the side ledges of the recesses and the arm portions are positioned generally horizontally. With the handles in the in-use positions, the leg portions are positioned generally horizontally along the floor ledges of the recesses and the arm portions are positioned generally vertically and closely adjacent each other.

DETAILED DESCRIPTION

Figure 1:
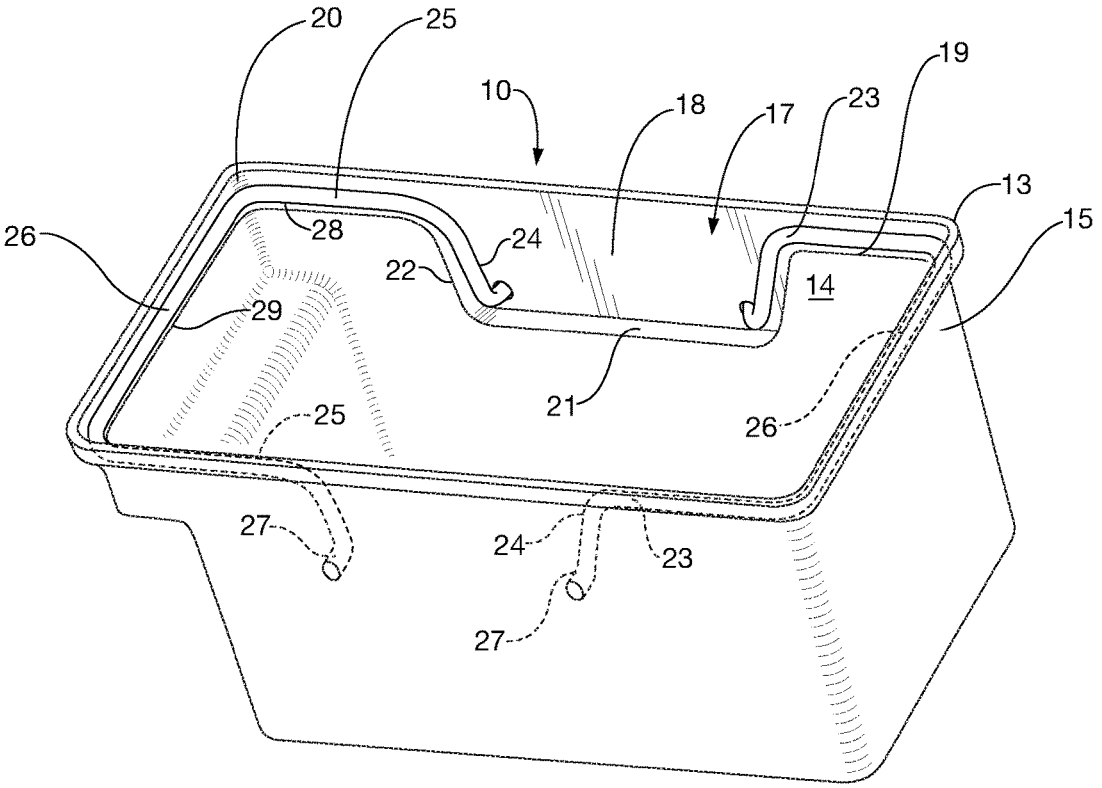
FIG. 1 is a perspective view of a refrigerator ice bin embodying principles of the invention in a preferred form.

With reference next to the drawings, there is shown an ice bin, container, tray or bucket 10 according to the present invention. The ice bin 10 is designed to fit adjacent the ice maker of the refrigerator so that it catches and stores ice cubes expelled from the ice maker. The ice bin 10 is removably mounted within a refrigerator shelf, drawer or slide.

The ice bin 10 includes a storage bin 13 having a pair of side walls 14, and an pair of end walls 15 and a bottom wall 16. The side walls 14 have a T-shaped recess 17 having a central base recess 18 extending to two oppositely extending arm recesses 19. It should be understood that the central base recesses only extend partially into side walls 14 so that the full extent of the sidewall may be used to capture ice from end wall to end wall. The term recess as used herein may also include a formation or contouring of a wall wherein the wall has generally the same thickness. Each central base recess 18 is defined by a bottom floor ledge 21 and a pair of oppositely disposed side edges 22 extending upwardly from the floor ledge 21. The end walls 15 also have grip recesses 20 which extend directly from the arm recesses 19. The arm recesses 19 are defined by side top ledges 28 while the grip recesses 20 are defined by end top ledges 29. The bin 13 may be made of any conventional material, such as plastic, metal, or the like.

The ice bin 10 also includes a pair of pivotable handles 23 coupled to the storage bin 13. Each handle 23 has a pair of generally L-shaped end portions which include a pair of leg or first portions 24 extending to a pair of arm or second portions 25, and a grip portion 26 extending between or bridging the pair of arm portions 25. The leg portions 24 includes an out turned end mount 27 pivotally coupled to the bin 13 for pivotal movement of the handles 23. The end mount 27 may be coupled to the bin 13 through a simple mounting hole through which the end mount 27 may extend for pivotal movement. The handle 23 may be made of any conventional material, such as plastic, metal, or the like.

Figure 2:
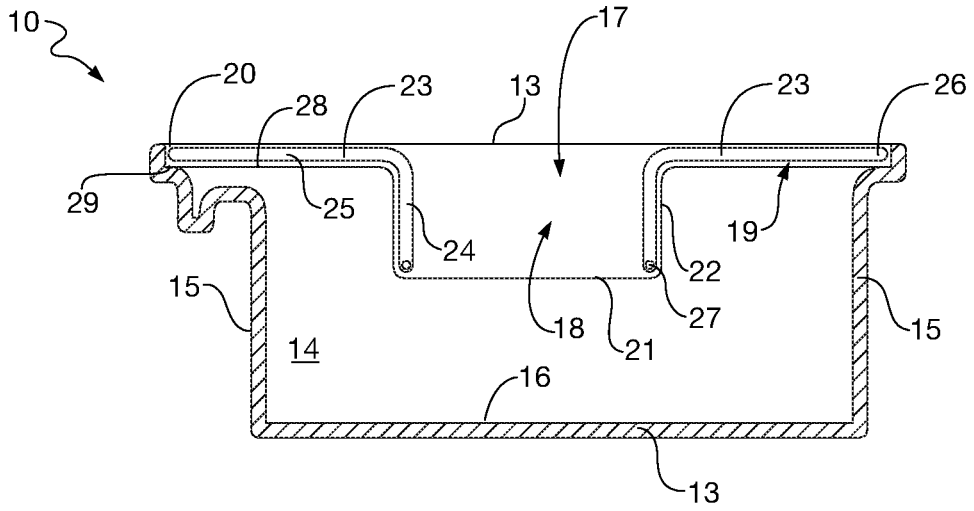
FIG. 2 is cross-sectional side view of the refrigerator ice bin of FIG. 1, shown in a stowed configuration.
Figure 3:
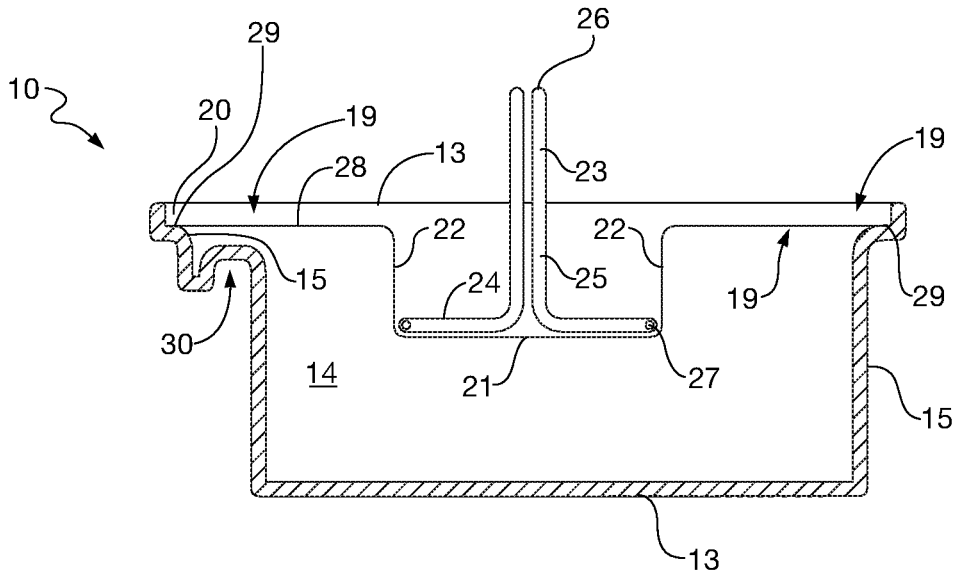
FIG. 3 is cross-sectional side view of the refrigerator ice bin of FIG. 1, shown in a transportable configuration.

In use, the handles 23 are pivotal between a stowed position, shown in FIGS. 1 and 2, and an in-use or transportable position, shown in FIG. 3. With the handles 23 in their stowed position, the handle leg portions 24 reside vertically within the central base recess 18 and generally along the length of the side edges 22. The arm portions 25 reside horizontally within the side wall arm recesses 19 generally along the length of the side top ledges 28. The grip portion 26 resides horizontally within the end wall grip recesses 20 generally along the length of the end top ledges 29.

Should it be desired to remove the ice bin from the refrigerator, the handles 23 are moved from their stowed configuration to their transportable or in-use configuration, shown in FIG. 3. To do so, the handles 23 are pivoted along end mounts 27 so that the leg portions 24 are moved to a horizontal position within central base recess 18 generally along and abutting the length of the bottom floor ledge 21, and the arm portions 25 are moved to a vertical position adjacent and abutting each other so that they are partially within the central base recess 18 and partially extending beyond the confines of the ice bin 13 along with the grip portion 26.

With the handles 23 in their in-use configuration, one may easily grasp the grip portions 26 and carry the ice bin to another location as the grip portions 26 are outside the confines of the storage bin 13, and therefore, unencumbered by the ice stored therein. It should be understood that by separating the end mounts 27 of the handles far apart from each other the end mounts 27 of the handles 23 are separated from each other a greater distance to provide a greater degree of stability, i.e., this separation of the mounting location restricts rocking of the ice bin during transport or movement. The abutment of the handles against each other prevents pivotal movement of the storage bin coupled to the handles. This is further enhanced by the abutment of the handle leg portions 24 against the bottom floor ledge 21 which also provides stability between the handles and the storage bin 13. Also, by residing the handles within the confines of the storage bin the overall dimensions of the ice bin are minimized while also protecting the handles from harm.

It should be understood that the term ledge, as used herein, is intended to denote an area which is indented, extends, or offset laterally from an adjoining wall. The ledge may also be formed by a protrusion or elongated ridge extending from the sidewalls 14 or end walls 15.

It should be understood that an end wall 15 may also be conformed to include a step or upwardly extending recess 30 to provide a grip to enable one to pull upon the ice bin for initial removal purposes.

It should be understood that the term generally vertical is intended to include a generally upright orientation and is not intended to denote a perfectly vertical orientation. Similarly, the term generally horizontal is intended to include a generally lateral orientation and is not intended to denote a perfectly horizontal orientation.

It thus is seen that a new ice bin is now provided which enables the easy gripping for transportation purposes while providing stability. While this invention has been described in detail with particular reference to the preferred embodiment thereof, it should be understood that many modification, redesign, additions and deletions, may be made thereto without departure from the spirit and scope of the invention as set forth in the following claims.

The invention claimed is:

1. A refrigerator ice bin comprising, a storage bin having a bottom wall, a pair of oppositely disposed side walls extending from said bottom wall, and a pair of oppositely disposed end walls extending from said bottom wall, each said side wall having a recess therein defined by a floor ledge and two oppositely disposed side ledges extending upwardly from said floor ledge, and a pair of handles pivotally coupled to said storage bin side walls, each said handle having a pair of leg portions, a pair of arm portions extending from said leg portions, and a grip portion bridging said arm portions opposite said leg portions, said leg portions being coupled to said storage bin for pivotal movement of said handles between a stowed position and an in-use position, with said handles in said stowed positions said leg portions are positioned generally vertically along said side ledges of said recesses and said arm portions are positioned generally horizontally, and with said handles in said in-use positions said leg portions are positioned generally horizontally along said floor ledges of said recesses and said arm portions are positioned generally vertically, wherein each said recess of said side walls includes a base recess defined by said floor ledge and said side ledges and two oppositely disposed arm recesses extending from said base recess, each said arm recess being defined by a side top ledge, with each said handle in said stowed position said arm portions are aligning along said side top ledges.

2. A refrigerator ice bin comprising, a storage bin having a bottom wall, a pair of oppositely disposed side walls extending from said bottom wall, and a pair of oppositely disposed end walls extending from said bottom wall, each said side wall having a T-shaped recess having a central base recess and two oppositely disposed arm recesses extending outwardly from said central base recess, and a pair of handles pivotally coupled to said storage bin side walls, each said handle having two oppositely disposed generally L-shaped end portions and a grip portion extending between said L-shaped end portions, each L-shaped end portion has a leg portion with a first end pivotally coupled to said storage bin and a second end extending to an arm portion, said leg portion being coupled to said storage bin for pivotal movement of said handle between a stowed position and an in-use position, with said handles in said stowed positions said leg portions are positioned generally uprightly within said central base recess and said arm portions are positioned generally laterally within said arm recesses, and with said handles in said in-use positions said leg portions are positioned generally laterally within said central base recesses and said arm portions are positioned generally uprightly within said central base recess.

* * * * *